US009393753B2

(12) United States Patent
Pettersson

(10) Patent No.: US 9,393,753 B2
(45) Date of Patent: Jul. 19, 2016

(54) INFEED GUIDE SYSTEM

(75) Inventor: Niklas Pettersson, Sandy, UT (US)

(73) Assignee: Packsize LLC, Salt Lake City, UT (US)

( * ) Notice: Subject to any disclaimer, the term of this patent is extended or adjusted under 35 U.S.C. 154(b) by 817 days.

(21) Appl. No.: 13/805,602

(22) PCT Filed: Jun. 28, 2011

(86) PCT No.: PCT/US2011/042096
§ 371 (c)(1),
(2), (4) Date: Apr. 11, 2013

(87) PCT Pub. No.: WO2012/003167
PCT Pub. Date: Jan. 5, 2012

(65) Prior Publication Data

US 2013/0210597 A1 Aug. 15, 2013

Related U.S. Application Data

(60) Provisional application No. 61/361,114, filed on Jul. 2, 2010.

(51) Int. Cl.
*B31B 5/02* (2006.01)
*B65H 23/28* (2006.01)
(Continued)

(52) U.S. Cl.
CPC *B31B 5/02* (2013.01); *B65H 23/28* (2013.01); *B31B 1/10* (2013.01); *B31B 2201/0205* (2013.01); *B31B 2201/0282* (2013.01); *B65B 11/18* (2013.01); *B65B 59/00* (2013.01); *B65B 2210/04* (2013.01); *B65H 20/00* (2013.01); *B65H 2402/31* (2013.01); *B65H 2701/11231* (2013.01)

(58) Field of Classification Search
CPC ..... B31B 5/02
See application file for complete search history.

(56) References Cited

U.S. PATENT DOCUMENTS 2,181,117 A 11/1939 Brenn
3,628,408 A 12/1971 Rod et al.
(Continued)

FOREIGN PATENT DOCUMENTS

CN 1191833 9/1998
EP 0030366 6/1981
(Continued)

OTHER PUBLICATIONS

European Search Report for EP10739040 dated Jan. 31, 2013.
(Continued)

*Primary Examiner* — Hemant M Desai
*Assistant Examiner* — Mobeen Ahmed
(74) *Attorney, Agent, or Firm* — Workman Nydegger

(57) ABSTRACT

Methods, devices, apparatus, and assemblies for converting fanfold material into packaging templates are disclosed. A converting system includes a converting machine that performs various conversion functions on the fanfold material. An infeed guide system directs the fanfold material from one or more stacks into the converting machine without folding, creasing, or otherwise compromising the fanfold material. The infeed guide system includes infeed guides with substantially S-shaped segments. The infeed guide system also includes a frame structure that substantially maintains the curvature of the substantially S-shaped segments within a desired range to prevent damage to or jamming of the fanfold material in the infeed guide system.

19 Claims, 6 Drawing Sheets

(51) Int. Cl.

| | |
|---|---|
| *B31B 1/10* | (2006.01) |
| *B65H 20/00* | (2006.01) |
| *B65B 11/18* | (2006.01) |
| *B65B 59/00* | (2006.01) |

(56) References Cited

U.S. PATENT DOCUMENTS

| | | | | |
|---|---|---|---|---|
| 3,743,154 | A | 7/1973 | Brewitz | |
| 4,094,451 | A | 6/1978 | Wescoat | |
| 4,264,200 | A | 4/1981 | Tickner | |
| 4,838,468 | A * | 6/1989 | Lesse | B65H 27/00 226/76 |
| 5,058,872 | A | 10/1991 | Gladow | |
| 5,836,498 | A | 11/1998 | Turek | |
| 5,941,451 | A | 8/1999 | Dexter | |
| 6,189,933 | B1 | 2/2001 | Felderman | |
| 6,840,898 | B2 | 1/2005 | Pettersson | |
| 7,100,811 | B2 | 9/2006 | Pettersson | |
| 7,647,752 | B2 | 1/2010 | Magnell | |
| 2002/0125712 | A1 | 9/2002 | Felderman | |
| 2004/0060264 | A1 | 4/2004 | Miller | |
| 2005/0103923 | A1 * | 5/2005 | Pettersson | B65H 20/00 242/615.2 |
| 2008/0020916 | A1 | 1/2008 | Magnell | |
| 2009/0199527 | A1 | 8/2009 | Wehr et al. | |
| 2011/0319242 | A1 | 12/2011 | Pettersson | |

FOREIGN PATENT DOCUMENTS

| | | |
|---|---|---|
| EP | 0359005 | 3/1990 |
| GB | 1362060 | 7/1974 |
| JP | 5689937 | 7/1981 |
| RU | 2015030 | 6/1994 |
| SE | 450829 | 8/1987 |
| WO | 2010091043 | 8/2010 |
| WO | 2012003167 | 1/2012 |

OTHER PUBLICATIONS

European Search Report for EP80107577.1 dated Feb. 3, 1981.
European Search Report for EP89115688.7 dated Feb. 11, 1989.
U.S. Appl. No. 13/147,787, Apr. 17, 2015 (mailing date), Final Office Action.
U.S. Appl. No. 13/147,787, Sep. 30, 2015 (mailing date), Office Action.
International Search Report and Written Opinion from PCT/US2010/022983 dated Apr. 13, 2010.
International Search Report for PCT/US2011/042096 dated Oct. 28, 2011.

* cited by examiner

INFEED GUIDE SYSTEM

This application claims priority to, and the benefit of, PCT Application Serial No. PCT/US2011/042096, filed on Jun. 28, 2011, and entitled "INFEED GUIDE SYSTEM", which also claims priority to and the benefit of, U.S. Provisional Patent Application No. 61/361,114, entitled "INFEED GUIDE SYSTEM", filed on Jul. 2, 2010, which is incorporated herein in its entirety.

BACKGROUND

1. Technical Field

Exemplary embodiments of the invention relate to apparatuses, systems, devices, and methods for feeding and guiding materials into a converting machine. More particularly, example embodiments relate an infeed guide system usable for feeding fanfold packaging materials into a converting machine that produces packaging templates from the packaging materials.

2. The Relevant Technology

The automating of processes has long been a goal of industrialized society, and in virtually any industry in which a product is produced, some type of automated process is likely to be used. Oftentimes, the automated process may make use of modern technological advances that are combined into one or more automated machines that perform functions used to produce a product. The product produced by the automated machine may itself make use of raw materials. Such materials may themselves be loaded, provided, or otherwise introduced into the automated machine using an automated process, or such loading may be manual. Particularly where the loading is performed using an automated process, the raw materials may be positioned near the machine to facilitate loading.

The packaging industry is one example industry that has benefited greatly in recent years from the use of automated technology. For instance, boxes and other types of packaging may be formed out of paper-based products (e.g., corrugated board), and an automated converting machine may be programmed to use one or more available tools to perform a number of different functions on the corrugated board. When loaded into the converting machine, the corrugated board may be cut, scored, perforated, creased, folded, taped, or otherwise manipulated to form a box of virtually any shape and size, or formed into a template that may later be assembled into a box. One example of such a converting machine can be found in U.S. Pat. No. 6,840,898, which is expressly incorporated herein by this reference, and which may use various laterally or vertically spaced paths, so that multiple lines of packaging templates can be individually or simultaneously produced. In effect, the converting machine starts with a raw form of corrugated board (e.g., fanfold corrugated board in one or more separate feed paths) and converts the raw form into a template form that may then be assembled into a box or other type of package.

A converting machine that produces packaging templates may thus produce the packaging templates only after the corrugated board or other packaging material is introduced into the machine. Conventional fanfold configurations use stacks of multiple layers of packaging material. Each layer is approximately the same size and has pre-existing fanfold score or crease lines at each end to separate the layers and allow the fanfold material to stack on top of itself. Thus, the raw fanfold board may be stacked in a loading position proximate the converting machine.

To introduce the fanfold into the converting machine, various infeed systems have been developed. Some conventional infeed systems utilize infeed wheels to draw the fanfold into the converting machine. Conventional infeed wheels correspond to the dimensions of the fanfold score or crease lines. For example, fanfold material may have score or crease lines that are forty-eight inches apart. Therefore, conventional infeed systems can use infeed wheels having corners that are forty-eight inches apart. Such infeed wheels that match the length of the fanfold material are specifically designed to avoid creasing the layers of fanfold material between the score or crease lines as the additional creases have been seen as reducing the aesthetic appeal of the produced box template, and possibly the structural integrity of the box formed from the template.

By limiting the size of conventional infeed wheels to correspond directly to the size of the fanfold material layers, the infeed wheels may have a large size. With the large infeed wheels, the stack of raw materials must be placed further away from the converting machine, thus creating a large system footprint. With the large footprint, space is occupied that may otherwise be valuable and usable for other operations, and higher overhead clearance may be needed. Moreover, as conventional infeed guides are designed to use the pre-existing score or crease lines on the fanfold, conventional infeed guides are designed with a large radius to accommodate the turning of the fanfold from the infeed wheel into the converting machine in a manner that does not cause the fanfold to fold or bend between the predefined score lines on the edges of the stack of fanfold material. The conventional large radius design of infeed wheels produces a larger overall size of the infeed system which, in turn, also requires more space. Furthermore, because of the large size, conventional infeed wheels are more expensive to produce as they result in higher material, handling, and tooling costs, thus increasing the cost of the infeed system as a whole.

Because the stack of raw fanfold material and the size of conventional infeed wheels can be set apart at some distance, there is also an increased chance of inattentive operators creating safety hazards in using the converting machine. For example, the space between the stack of fanfold material and the converting machine may allow space for an inattentive operator to walk between the stack of fanfold material and the converting machine. As the infeed wheel rotates to feed the fanfold material, the rotating infeed wheel may strike the careless operator.

Additionally, where the size of the infeed wheel is generally the same size as the distance between scores or creases in the fanfold material, changing to a different size of fanfold material may result in a need to modify or change out the infeed wheel to correspond to the different size of fanfold material. For instance, the infeed wheel may have expandable and/or retractable corners that allow some variation in size, although large changes in size of fanfold material may require swapping out for a different infeed wheel, and either modification or replacement of a wheel may cause significant downtime for the converting machine.

While many wheel-type infeed systems can only feed one width of fanfold material at a time, some infeed systems are equipped with multiple infeed wheels that are arrange side-by-side. For instance, an infeed system could have two or three infeed wheels so that two or three different sizes of fanfold material could be simultaneously loaded and fed into the converting machine. Conceivably, a wheel-type infeed system could have more than three infeed wheels so that even more sizes of fanfold material could be simultaneously loaded. However, the entry into a converting machine is typically not wide enough to receive more than two or three side-by-side fanfold materials, especially with wider fanfold material widths. Thus, wheel-type infeed systems are typically limited to no more than three simultaneous fanfold widths.

Also, during a converting process, a converting machine may partially back-out the fanfold material to create the various templates. Because of the large size of the conventional infeed wheels, there is a significant resistance to backward movement of the fanfold material that can frequently cause a conventional converting machine to jam, thereby increasing downtime and operating costs.

Other types of infeed systems have been developed that do not use infeed wheels to feed the fanfold material into the converting machine. These systems typically employ at least one infeed guide that guides the fanfold material from the fanfold stack partially or entirely to the entry location on the converting machine. For instance, the infeed guide may include an entry segment, one or more intermediate segments, and an exit segment. The entry segment can simply be on opening through which the fanfold material can be inserted into the infeed guide. The one or more intermediate segments can include upper and lower guide rods and/or upper and lower flexible guide strips that are spaced apart from one another so as to form a guided passage for the fanfold material. The fanfold material is fed between the upper and lower guide rods/strips so that it passes through the guided passage and out of the exit segment. In some cases the exit segment is adjacent to and/or coupled to the converting machine, while in other cases the exit segment is spaced a distance away from the converting machine.

Like the infeed wheel type systems, these wheel-less type systems can have multiple side-by-side infeed guides to enable the simultaneous loading of multiple sizes of fanfold materials. In addition, these types of infeed systems can also have multiple infeed guides disposed vertically one above another. For instance, an infeed system may have two infeed guides horizontally offset from one another such that the inked guides are positioned side-by-side. Disposed vertically above the two infeed guides could be two more infeed guides that are horizontally offset from one another such that the second pair of infeed guides are positioned side-by-side one another and generally vertically above the first set of infeed guides. Thus, an infeed system may have several vertically offset rows and several horizontally offset columns of infeed guides for loading multiple sizes of fanfold material into a converting machine.

In a case where the infeed system has multiple vertically offset rows, the infeed system and/or the converting machine may be equipped with a cassette changer that vertically repositions the infeed guides so that the desired fanfold material can be fed into the converting machine. For instance, in a case where the infeed system includes three vertically offset rows of infeed guides, a cassette changer could be employed to adjust the vertical height of the infeed guides. More specifically, the cassette changer could include three vertically offset cassettes, each of which is associated with one of the three vertically offset infeed guides. If the fanfold material being fed through the lowest infeed guide is desired, the cassette changer could adjust the height of the cassette(s) so that the cassette associated with the lowest infeed guide is aligned with the entry of the converting machine. Once the desired cassette and associated infeed guide are aligned with the entry of the converting machine, the desired fanfold material can be fed into the converting machine. Likewise, if the fanfold from the top infeed guide is desired, the cassette changer could adjust the height of the cassette(s) so that the cassette associated with the top infeed guide is aligned with the entry of the converting machine so the desired fanfold material can be fed into the converting machine.

Similar to the wheel-type infeed systems, previous wheel-less type infeed systems have presented various challenges. For instance, the relative positioning of the exit segment of the infeed guides and the entry of the converting machine often creates a path for the fanfold material that increases the likelihood that additional creases or scores may be created in the fanfold material. More specifically, the exit segment of the infeed guides may be significantly vertically offset from the entry of the converting machine. As the fanfold material exits the entry segment of the infeed guide in a generally horizontal direction, it is pulled downward toward the entry of the converting machine, at which time it is pulled into the converting machine in a generally horizontal direction. Thus, in order to transition from the guide passage created by the infeed guides into the entry of the converting machine, the fanfold material abruptly changes direction at least two times. In order for the fanfold material to follow these abrupt direction changes, it is likely that additional creases or scores may be created in the fanfold material. While the likelihood of creating additional creases or scores in the fanfold material can be reduced by spreading the infeed system and the converting machine further apart (i.e., so that the directional changes of the fanfold material are less abrupt), this can significantly increase the overall foot print of the system as a whole. As alluded to above, it is undesirable to increase the system footprint since it would take up valuable space that could be used for other purposes.

In some wheel-less type infeed systems, the exit segment of the infeed guides is located adjacent the entry of the converting machine. In such systems, at least of part of the intermediate segment includes a curved portion that is designed to guide the fanfold material from a vertical high point in the feed path to the entry of the converting machine without creating additional creases or scores in the fanfold material. In particular, the curved portion is designed to guide the fanfold material without abrupt changes in direction that can cause the creases and scores to form. Nevertheless, as the height of the exit segments are changed (e.g., by the cassette changer to align the desired infeed guide with the converting machine entry), the curves in the curved portion of the infeed guides change shapes. These shape changes can lead to more abrupt directional changes for the fanfold material. Consequently, more friction is created as the fanfold material passes through the infeed guides and the likelihood of the formation of more creases and scores increases, as does the likelihood of the fanfold becoming jammed somewhere in the system.

With either type of known wheel-less infeed system, there is also a high likelihood of the fanfold material being creased, scored, or becoming jammed in the infeed system when the fanfold material is fed backwards. As noted above, at some points during the converting process, the converting machine may feed the fanfold material backwards through the infeed system. In such circumstances, if the fanfold material is pushed through a path that requires abrupt direction changes or that is high friction, there is a high probability that the fanfold material will be bent, creased, scored, otherwise damaged, or will become jammed in the infeed system. As will be appreciated, these results are undesirable since they lead to an inferior box template and/or create significant amounts of downtime for the infeed system while the jammed material is removed.

Accordingly, there exists a need for alternative infeed systems that are more efficient, less costly, less likely to damage the fanfold material, and which are less prone to downtime and delay.

The subject matter claimed herein is not limited to embodiments that solve any disadvantages or that operate only in environments such as those described above. Rather, this background is only provided to illustrate one exemplary technology area where some embodiments described herein may be practiced.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
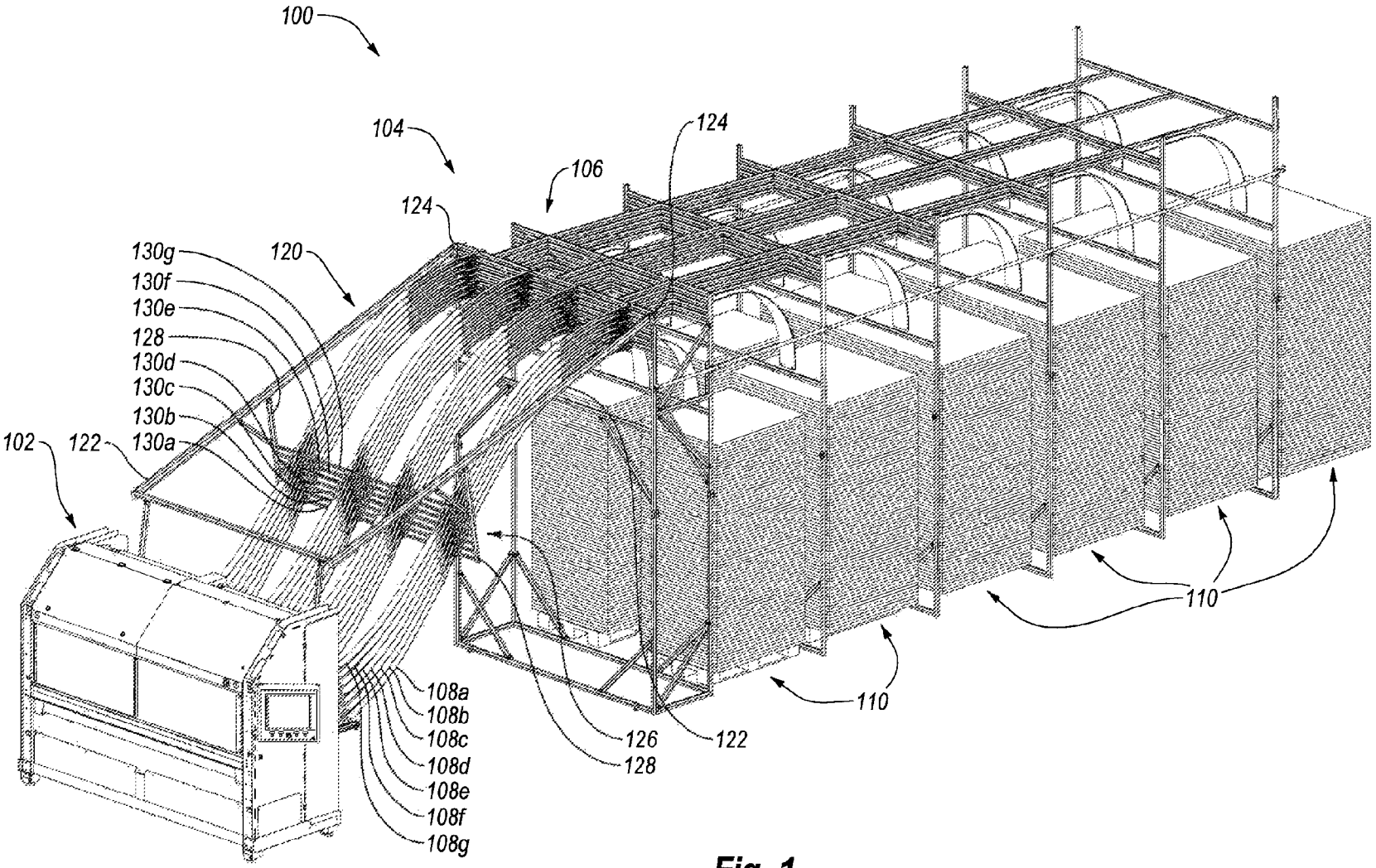
FIG. 1 illustrates a perspective view of an infeed guide system according to an exemplary embodiment of the present invention.

The embodiments described herein extend to methods, devices, systems, assemblies, and apparatuses for feeding and guiding materials into a converting machine. Such are configured to, for example, reliably feed fanfold packaging materials into a converting machine in a simple and efficient manner that minimizes or eliminates the formation of additional creases or scores in the fanfold material and which limits or prevents the fanfold material from becoming jammed in the system.

In describing and claiming the present invention, the term "converting machine" is utilized herein to generically describe a' variety of different machines that may take raw materials and convert the raw materials into a different form or structure. In particular, "converting machine" as used herein includes packaging machines that receive packaging materials (e.g., corrugated board) and cut, perforate, crease, score, fold, or otherwise modify the packaging materials to produce a box template. The term "converting machine" may, however, refer to other types of machines and industries, and is not necessarily limited to machines used to make box templates, or to machines usable in the packaging industry.

Further, in describing and claiming the present invention, the term "packaging materials" is utilized herein to generically describe a variety of different types of materials that may be converted using a converting machine. In particular, "packaging materials" may be used to effectively refer to any material that can be converted from a raw form into a usable product, or into a template for a usable product. For instance, paper-based materials such as cardboard, corrugated board, paper board, and the like may be considered "packaging materials," although the term is not necessarily so limited. Accordingly, while examples herein describe the use of corrugated board and fanfold corrugated board, such are merely exemplary and not necessarily limiting of the present application.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Further, numerical data may also be expressed or presented herein. It is to be understood that such numerical data is used merely to illustrate example operative embodiments. Moreover, numerical data provided in range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. Furthermore, such numerical values and ranges are intended to be non-limiting examples of example embodiments, and should not be construed as required for all embodiments unless explicitly recited as such in the claims.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be obvious, however, to one of ordinary skill in the art that the present invention may be practiced without these specific details. In other cases, well known aspects of fanfold materials, infeed systems, and converting machines, as well as methods and general manufacturing techniques are not described in detail herein in order to avoid unnecessarily obscuring the novel aspects of the present invention.

FIGS. 1-4 and the following discussion are intended to provide a brief general description of exemplary devices in which embodiments of the invention may be implemented. While an infeed system for feeding fanfold materials is described below, this is but one single example, and embodiments of the invention may be implemented with other types of materials. Accordingly, throughout the specification and claims, the phrases "fanfold material," "fanfold stack," and "fanfold" and the like are intended to apply broadly to any type of item that can be fed through an infeed guide system as described herein.

FIGS. 1-4 thus illustrate one example of a converting system 100 implementing some aspects of the present invention. The converting system in FIGS. 1-4 is only one example of a suitable system and is not intended to suggest any limitation as to the scope of use or functionality of an embodiment of the invention. Neither should the system be interpreted as having any dependency or requirement relating to any one or combination of components illustrated in the system.

FIGS. 1-4, for example, provide perspective, side, and overhead views of converting system 100, or portions thereof. Converting system 100 is broadly illustrated as including a converting machine 102 and an infeed guide system 104. In the illustrated embodiment, infeed guide system 104 includes a frame 106 having a plurality of infeed guides 108*a-g* that guide the movement of fanfold material 110 as it is fed into converting machine 102. In this example embodiment, one or more stacks of fanfold material 110*a-g* are placed in, under, or adjacent to frame 106 so that fanfold material 110 can be guided to converting machine 102 between infeed guides 108.

Each stack of fanfold material 110 may be formed of a plurality of different layers of packaging materials. For instance, according to one example embodiment, a score or crease line may be formed at the opposing edges of each layer of packaging materials in the stack of fanfold material 110, and can demark the transition from one layer to the next. Each layer may be generally positioned in the stack such that it is vertically higher than a prior layer, and vertically lower relative to a subsequent layer.

As noted herein, a particular aspect of the score lines formed in fanfold material 110 is that they allow fanfold material 110 to fold over itself to form the multiple layers of the fanfold stack. Thus, when viewing a fanfold stack from a side or overhead view, score or crease lines can be at the edges of the fanfold stack. As fanfold material 110 from the fanfold stacks is fed to converting machine 102, infeed guides 108 may direct it off the fanfold stack and to the entry of converting machine 102. Upon entry into converting machine 102, fanfold material 110 can be cut, creased, scored, folded, and the like in order to from a package and/or package template.

Figure 2:
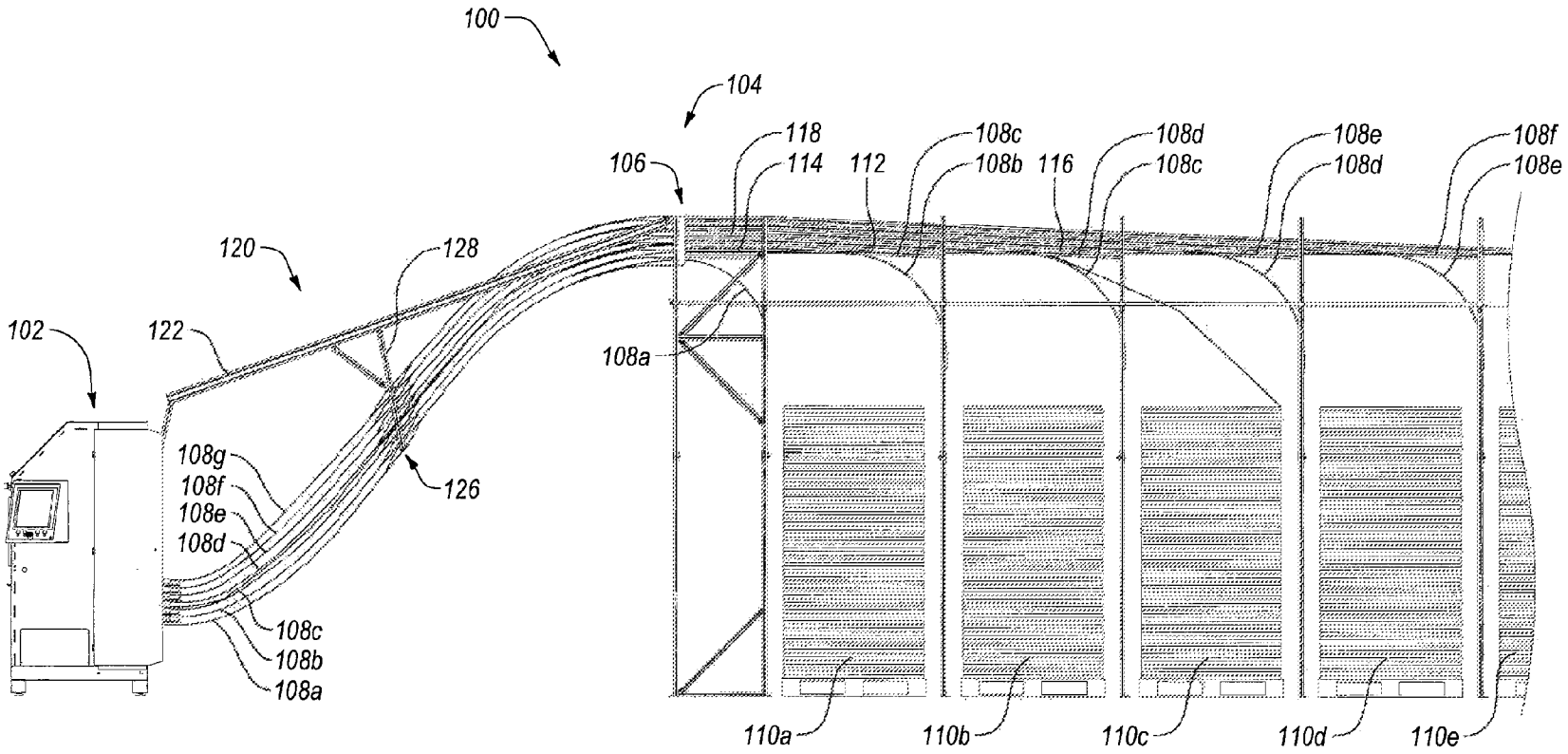
FIG. 2 illustrates a side elevational view of the infeed guide system of FIG. 1.

Infeed guides 108 may include, for example, rails, rods, beams, and/or strips of material, whether straight, curved, rigid or flexible, between which fanfold material 110 may be positioned, and which collectively guide fanfold material 110 to converting machine 102. For instance, as illustrated in FIG. 2, infeed guide system 104 includes a plurality of infeed guides, referenced individually as infeed guides 108*a*-108*g*. Each infeed guide 108 may have one or more segments which cooperate with one or more segments of one or more adjacent infeed guides 108 to form guide passages through which fanfold material 110 can be guided to converting machine 102.

With further reference to FIG. 2, infeed guides 108*c* and 108*d* will be described in more detail. In addition to describing infeed guides 108*c* and 108*d*, the process of feeding fanfold material 110 from fanfold stack 110*c* to converting machine 102 will also be described. While the following description will focus primarily on infeed guides 108*c* and 108*d* and feeding fanfold material 110 from fanfold stack 110*c* to converting machine 102, one of ordinary skill in the art will appreciate that the structures, features, and functions of the other infeed guides 108 can be similar or identical to those described in connection with infeed guides 108*c* and 108*d*.

Each of infeed guides 108 can have one or more segments that cooperate with one or more segments from an adjacent infeed guide 108 to define a guide passage for fanfold material 110. For instance, infeed guide 108*c* includes four segments. Moving from right to left, the first segment of infeed guide 108*c* is formed of a flexible strip of material, such as plastic, nylon, fabric, or the like. This first segment is positioned generally above fanfold stack 110*b* and is curved up and away from fanfold stack 110*c* in the general direction of converting machine 102. In other embodiments, the first segment of infeed guide 108*c* may be formed of a more rigid material (e.g., metal, plastic, ceramic, etc.) that has been shaped or bent into a curved configuration as shown in the Figures. As will be discussed in greater detail below, this first segment of infeed guide 108*c* is configured to enable fanfold material 110 from fanfold stack 110*c* to readily enter a guide passage defined by infeed guides 108*c* and 108*d* with minimal likelihood of fanfold material 110 becoming jammed in infeed guide system 104 or being damaged (e.g., creased, scored, or folded) as it passes therethrough.

Continuing to the left, infeed guide 108*c* includes a second segment that is formed of a generally rigid rail or beam 112. Rail 112 can be oriented so that the end of rail 112 that is closer to fanfold stack 110*c* (i.e., the end of rail 112 connected to the curved first segment of infeed guide 108*c*) is vertically lower than the end of rail 112 that is further away from fanfold stack 110*c*. Thus, as fanfold material 110 from fanfold stack 110*c* is guided over this second segment of infeed guide 108*c*, the height of fanfold material 110 increases. As can be seen in FIG. 2, this second segment of infeed guide 108*c* generally extends over fanfold stack 110*a*. A third segment of infeed guide 108*c* is a generally horizontal rail or beam 114 that extends from the second end of rail 112.

The fourth segment of infeed guide 108*c* extends from the end of rail 114 to a cassette changer associated with converting machine 102. In the illustrated embodiment, the fourth segment of infeed guide 108*c* is generally S-shaped. More specifically, the fourth segment of infeed guide 108*c* includes at least two curved portions. The first curved portion extends from rail 114 in a generally downwardly curved direction. Even more particularly, the first curved section curves generally downward from a generally horizontal beginning to an angle of about 45°. Conversely, the second curved portion curves from an angle of about 45° to a generally horizontal ending at the cassette changer associated with converting machine 102.

The first and second portions of the fourth segment of infeed guide 108*c* may be formed of various materials. For instance, one or both portions may be formed of a flexible material, such as strips of plastic, vinyl, nylon, fabric, or the like. Alternatively, one or both portions may be formed of a generally rigid material, such as strips of metal. In still other embodiments, one portion may be formed of a generally rigid material while the other portion is formed of a flexible material. For instance, the first portion may be formed of curved or bent metal to generally maintain the curved configuration shown in the Figures, while the second portion is formed of a flexible plastic.

Infeed guide 108*d* is very similar to infeed guide 108*c*. More specifically, infeed guide 108*d* includes four segments that generally correspond to the four segments of infeed guide 108*c*. Even more particularly, infeed guide 108*d* includes a first segment formed of a flexible strip that is positioned generally over fanfold stack 110*c*. This first segment cooperates with the first segment of infeed guide 108*c* to define on entry segment through which fanfold material 110 from fanfold stack 110*c* enters into a guide passage defined between infeed guides 108*c* and 108*d*. A second segment of infeed guide 108*d* is formed of a slightly angled rail or beam 116 that extends over and is vertically spaced apart from the first and second segments of infeed guide 108*c* as well as extending over fanfold stacks 110*a* and 110*b*. Thus, the second segment of infeed guide 108*d* (e.g., rail 116) is about twice as long as the second segment of infeed guide 108*c* (e.g. rail 112). The third segment of infeed guide 108*d* is formed of a generally horizontal rail or beam 118 that extends over and is vertically spaced apart from the third segment of infeed guide 108*c* (e.g., rail 114). Finally, the fourth segment of infeed guide 108*d* is formed of two curved portion that are arranged in a generally S-shaped configuration like the fourth segment of infeed guide 108*c*. The fourth segment of infeed guide 108*d* extends over and is vertically spaced apart from the fourth segment of infeed guide 108*c*.

As noted, infeed guides 108*c* and 108*d* are vertically spaced apart so that a guide passage is formed therebetween. The guide passage formed between infeed guides 108*c* and 108*d* is arranged to allow fanfold material 110 to pass therethrough without being creased, folded, or jammed. For instance, the relatively large space between the first segments of infeed guides 108*c* and 108*d* allows for fanfold material 110 to easily unfold from fanfold stack 110*c* and enter the guide passage without significant resistance, folding, or creasing. Similarly, the relatively straight nature of the guide passage between the second and third segments of infeed guides 108*c* and 108*d* (e.g., between rails 112, 116 and 114, 118) allows for passage of fanfold material 110 without significant resistance, folding, or creasing.

Feeding fanfold material 110 from the top of frame 106 (e.g., at or near the second ends of rails 114, 118) to the entry of converting machine 102 without creating folds, scores, or creases or getting fanfold material 110 jammed typically poses the greatest challenge. However, arranging the fourth segments of infeed guides 108*c* and 108*d* as illustrated in the Figures and described above helps to limit or prevent jamming or the formation of additional creases, scores, or folds in fanfold material 110. More particularly, by arranging the fourth segments of infeed guides 108*c* and 108*d* into a generally S-shaped path allows for fanfold material 110 to be directed from the height of frame 106 down to the entry of converting machine 102 without abrupt directional changes. That is, each of the curved portions of the S-shaped segments has a radius large enough to enable fanfold material 110 to pass therearound without forming additional fold, creases, or scores in fanfold material 110.

Although forming infeed guides 108 with in an S-shape to allow for smooth passage of fanfold material 110, the S-shape may change during operation of the system. Such changes in the S-shape may be sufficient to cause fanfold material 110 to be more likely to be folded, creased, or scored, or become jammed during passage through the S-shape portion of infeed guides 108. For instance, the curvature of the S-shaped portion of infeed guides 108 may increase or decrease when certain operations are performed. The increase or decrease in the S-shape curvature means that the panels of fanfold material 110 may have to bend or fold in order to pass through the curves of the infeed guides 108 or to transition between horizontal and vertical paths.

One operation that may change the shape of the S-shaped portion of infeed guides 108 is adjusting the height of the portion of infeed guides 108 disposed adjacent to or associated with converting machine 102. As discussed herein, the lower end of the S-shaped portion of infeed guides 108 may be associated with a cassette changer. The ends of infeed guides 108 that are associated with the cassette change may be referred to as the distal end or exit portion of infeed guides 108. The cassette changer can adjust the height of the distal ends of infeed guides 108 so that a desired fanfold material 110 can be fed into converting machine 102. As will be appreciated by one of skill in the art, adjusting the height of the distal ends of infeed guides 108 can affect the S-shape of infeed guides 108.

For example, if fanfold material 110 being fed through the guide passage defined by infeed guides 108*a* and 108*b* was desired, the cassette changer could adjust the height of the distal ends of infeed guides 108 so that the vertical space between the distal ends of infeed guides 108*a* and 108*b* is aligned with the entry of converting machine 102. Once infeed guides 108*a* and 108*b* are so positioned, fanfold material 110 that is being fed between infeed guides 108*a* and 108*b* can be introduced into converting machine 102 for processing into a package template. Thereafter the cassette change could adjust the height of the distal ends of infeed guides 108 so that fanfold material 110 between two other infeed guides 108, such as infeed guides 108*e* and 108*f*, for example, could be introduced into converting machine 102.

When the cassette changer adjusts the height of the distal end of infeed guides 108 as described, the S-shape curvature of infeed guides 108 may change. For instance, when the cassette change increases the height of the distal ends of the infeed guides 108 (e.g., to feed fanfold material 110 between infeed guides 108*a* and 108*b*), the curvature of the S-shape formed by infeed guides 108 increases. The increased curvature of infeed guides 108 means that fanfold material 110 must bend more in order to pass through infeed guides 108. Bending of fanfold material 110 in this manner can undesirably lead to the formation of additional creases or folds in fanfold material 110.

Similarly, when the cassette change decreases the height of the distal ends of infeed guides 108 (e.g., to feed fanfold material 110 between infeed guides 108*e* and 108*f*), the curvature of the S-shape formed by infeed guides 108 decreases (e.g., becomes longer, straighter, and oriented at a steeper angle). The decreased curvature of infeed guides 108 means that fanfold material 110 must bend more as it enters and exits the S-shaped portion of infeed guides 108. Just prior to entering the S-shaped portion of infeed guides 108, fanfold material 110 is in a generally horizontal plane. In order to enter into the S-shape portion of infeed guides 108, fanfold material 110 would have to make a relatively abrupt downward turn as it comes out of the horizontal plane. A similarly abrupt turn would have to be made when fanfold material 110 exits the S-shaped portion of infeed guides 10. When entering into converting machine 102, fanfold material 110 is in a generally horizontal plane. Thus, to transition between the relatively steep inclined angle of the S-shape and the generally horizontal plane of the entry into converting machine 102, fanfold material 110 would have to make a relatively abrupt direction change. Whether entering or exiting the longer, straighter S-shaped infeed guides 108, fanfold material 110 would have to bend, which could undesirably cause the formation of creases or folds in fanfold material 110.

In order to maintain a desirable curvature for the S-shape of infeed guides 108, the illustrated embodiment also includes a pivoting frame 120. Pivoting frame 120 generally prevents the curvature of infeed guides 108 from increasing or decreasing beyond a point that would lead to the formation of folds or creases in fanfold material 110, or the jamming of fanfold material 110 in infeed guides 108.

In the illustrated embodiment, pivoting frame 10 includes two pivoting beams 122. A first end of each of pivoting beams 122 is pivotally coupled to frame 106 at pivots 124, while an opposing second end of each of pivoting beams 122 is operatively associated with the cassette changer. The second end of each pivoting beam 122 can be pivotally coupled to the cassette changer or otherwise associated with the cassette changer so that the heights of the second ends of pivoting beams 122 change when the cassette changer adjusts the height of the distal ends of infeed guides 108. Thus, the second ends of pivoting beams 122 are associated with the cassette changer in such a way that the changes in height of the second ends of pivoting beams 122 are interconnected or associated with the changes in height of the distal ends of infeed guides 108. For example, if the cassette changer increased the height of the distal ends of infeed guides 108 by 12 inches, the height of the second ends of pivoting beams 182 would also increase by 12 inches. The pivoting connections 124 between the first ends of pivoting beams 122 and frame 106 enables the heights of the second ends of pivoting beams 122 to change while substantially maintaining the heights of the first ends of pivoting beams 122.

Suspended from pivoting beams 122 is a grate 126, which includes generally vertical beams 128 and a plurality of cross beams 130 (identified individually as cross beams 130*a*-130*g*) connected between beams 128. Beams 128 are connected to pivoting beams 122 and cross beams 130 are connected between beams 128. The connection between beams 128 and pivoting beams 122 may be a pivoting connected to allow grate 126 to pivot relative to pivoting beams 122. Alternatively, as shown in the Figures, beams 128 may be fixedly or rigidly connected to pivoting beams 122 to prevent relative movement therebetween. In the illustrated embodiment, beams 128 are coupled to pivoting beams 122 about half way between the first and second ends of pivoting beams 122. Furthermore, beams 128 do not necessarily need to be vertical. Rather, as shown in FIGS. 2 and 3A-3C, beams 128 may depend from pivoting beams 122 so that beams 128 form an angle with the ground other than 90°.

Each of cross beams 130*a*-*g* is connected to at least one infeed guide 108 near the center of the S-shaped segment of the infeed guides 108. For instance, cross beam 130*a* is connected to infeed guide 108*a*, cross beam 130*b* is connected to infeed guide 108*b*, cross beam 130*c* is connected to infeed guide 108*c*, and so on. As noted above, the two portions of each S-shaped segment of infeed guides 108 may be formed of different materials. In such an embodiment, the first portions may be connected between frame 106 and cross beams 130, while the second portions are connected between the cross beams 130 and the cassette changer.

Cross beams 130*a*-*g* are configured to raise and lower the center portions of the S-shaped segments of infeed guides 108 when the cassette changer adjusts the height of the distal ends of infeed guides 108. By adjusting the height of the center portions of the S-shaped segments when the height of the distal ends of the infeed guides 108 are adjusted, a desired curvature of the S-shaped segment can be substantially maintained at least within a desired range. For instance, when the cassette changer decreases the height of the distal ends of infeed guides 108 (e.g., moves from the height shown in FIG. 3C to the height in FIG. 3A), the S-shape would normally lengthen and straighten out as discussed above. With pivoting frame 120, however, as the cassette changer decreases the height of the distal ends of infeed guides 108, the height of the second ends of pivoting beams 122 also decrease. As the height of the second ends of pivoting beams 122 decreases, the heights of beams 128 and cross beams 130 also decrease. Decreasing the heights of cross beams 130 causes the heights of the center points of the S-shaped segments to also decrease since cross beams 130 are coupled to the center points of the S-shaped segments of infeed guides 10. Understandably, lowering the heights of the center points of the S-shaped segments of infeed guides 108 at the same time as the distal ends are lowered will reduce the amount of straightening that takes place in the S-shaped segments of infeed guides 108. That is, lowering the center point of the S-shaped segments of infeed guides 108 at the same time the distal ends are being lowered helps maintain the curvature of infeed guides 108 within a range that allows for smooth passages of fanfold material 110 therethrough without folding, creasing, or jamming.

Similarly, when the cassette changer increases the height of the distal ends of infeed guides 108 (e.g., moves from the height shown in FIG. 3B to the height in FIG. 3C), the height of second ends of pivoting beams 122 increases, which causes the height of vertical beams 128 and cross beams 130, and in turn the height of the center points of the S-shaped segments of infeed guides 108, to increase. Increasing the height of the center points of the S-shaped segments of infeed guides 108 at the same time the height of the distal ends are being increased likewise helps prevent the curvature of the S-shaped segments from increasing too much and, thus, helps maintain the curvature of the S-shaped segments within a range that allows for smooth passage of fanfold materials through infeed guides 108 without folding, creasing, or jamming.

Figure 3A:
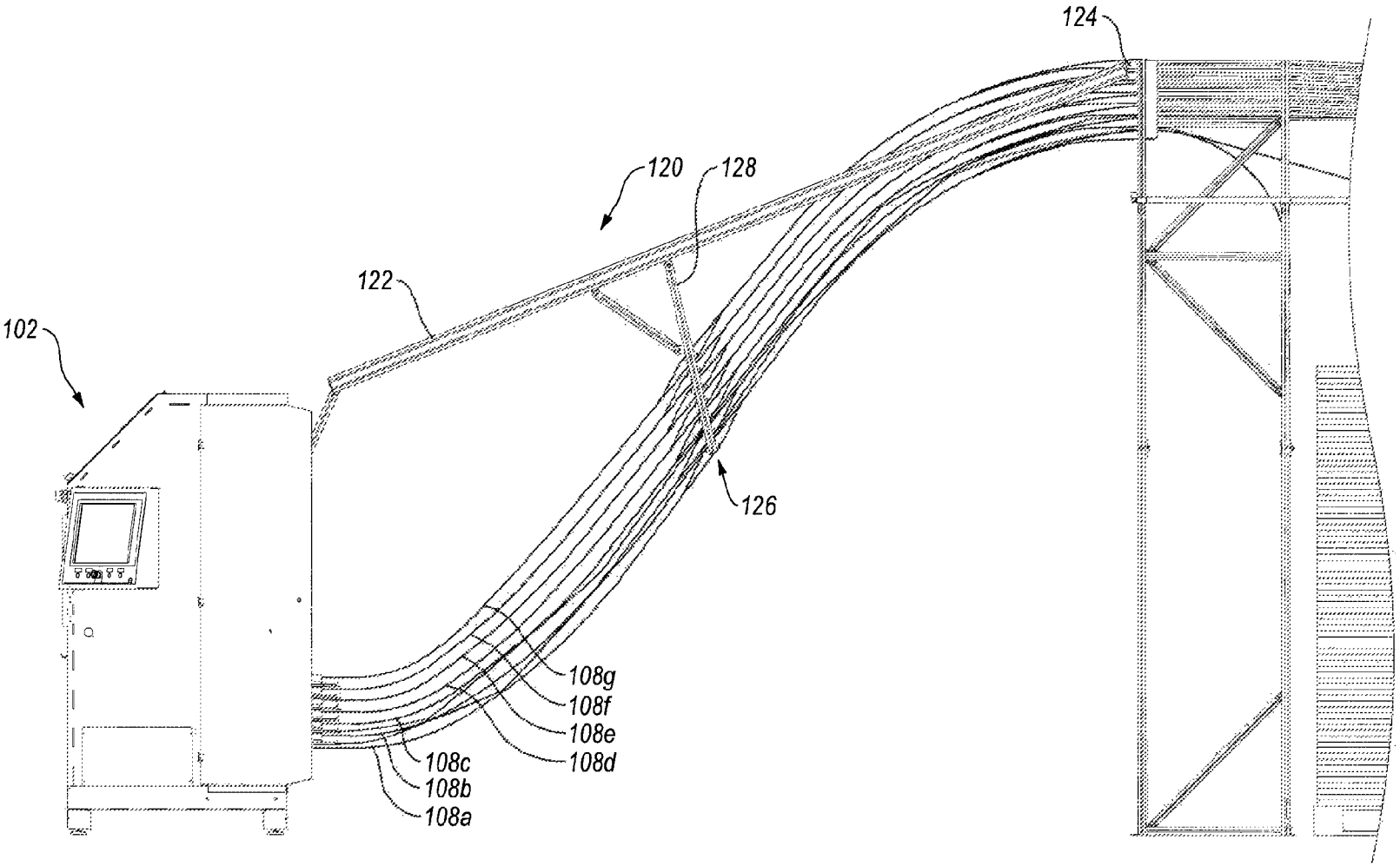
FIGS. 3A-3C illustrate partial side elevational views of the infeed guide system of FIG. 1, showing the infeed guides in various positions.
Figure 3B:
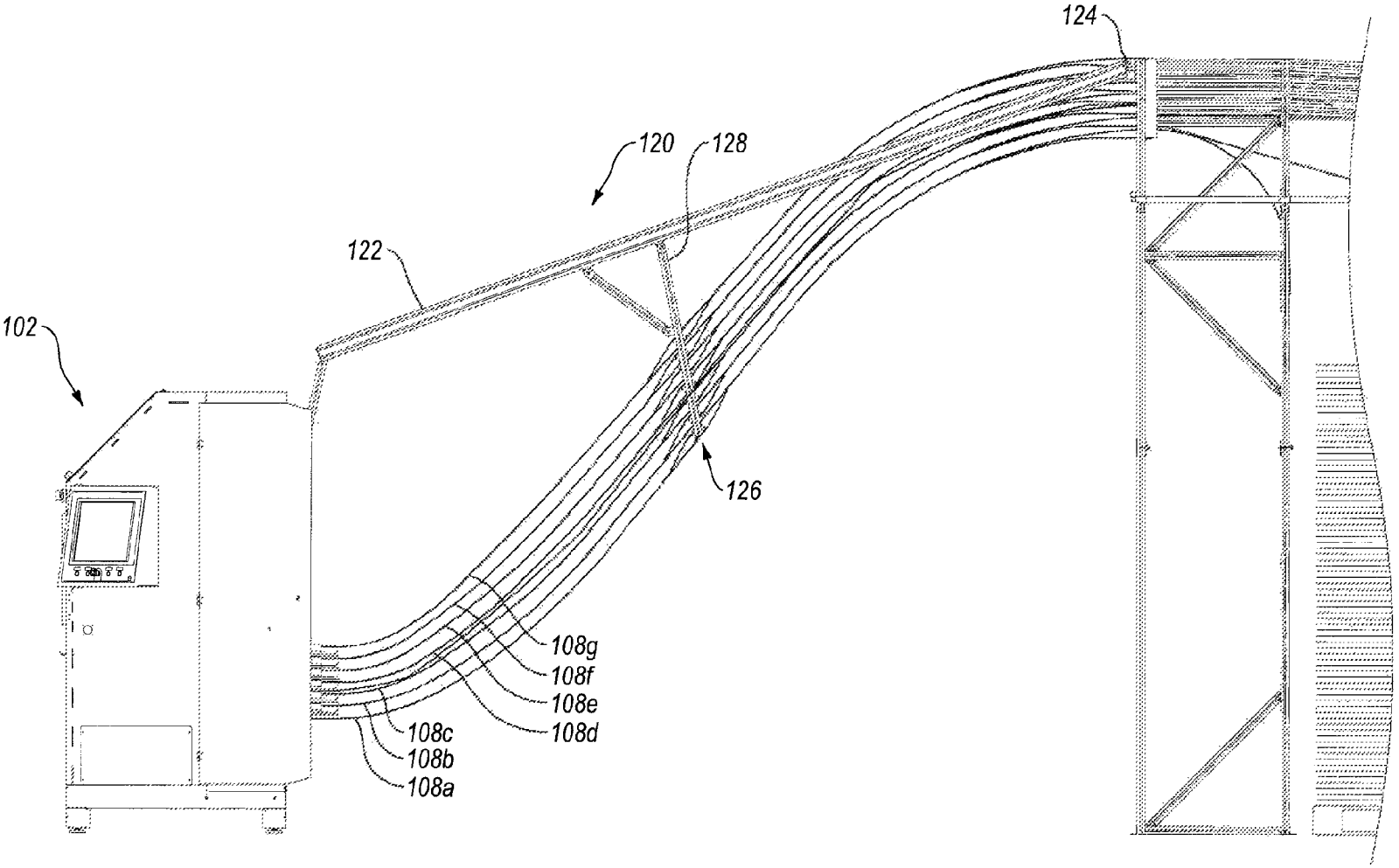
Figure 3C:
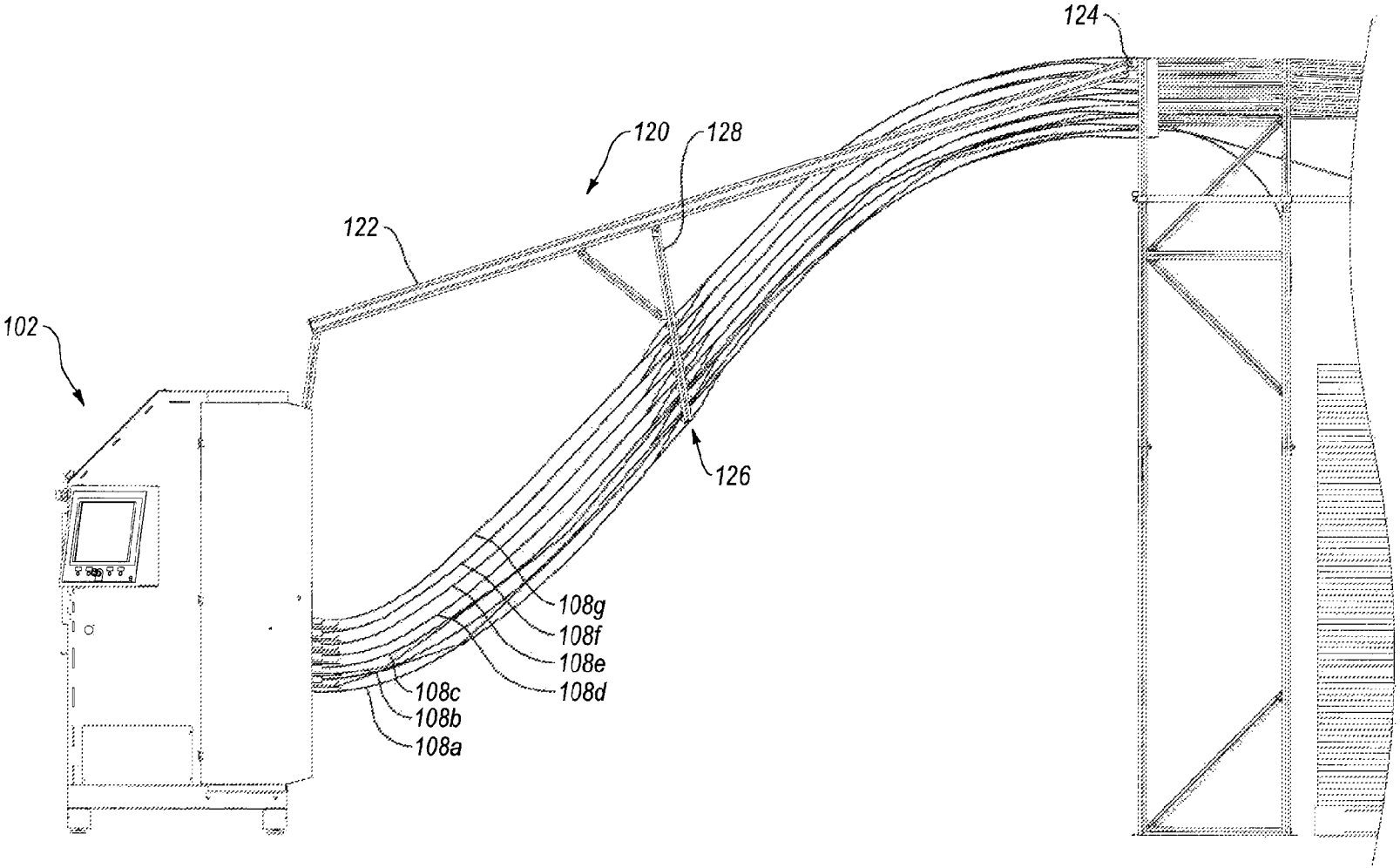

As noted above, beams 128 may be connected to pivoting beams 122 so that beams 128 form an angle with the ground that is other than 90°. As a result of this orientation, cross beams 130*a*-130*g* may be both vertically and horizontally offset from one another. Furthermore, as pivoting beams 122 pivot up and down (e.g., as a result of the cassette changer changing heights), cross beams 130*a*-130*g* may move vertically and horizontally. The vertical and horizontal movement of cross beams 130*a*-130*g* can assist with adjusting the curvature of the S-shaped segments of infeed guides 108 to maintain the curvature within a range that will reduce or prevent the formation of creases, scores, and the like in fanfold material 110. As shown in FIGS. 3A-3C, for example, as the cassette changer increases the heights of the distal ends of infeed guides 108, the height and orientation of grate 126 changes. More specifically, increasing the height of the distal ends of infeed guides 108 results in an increase in the height of grate 126, and thus the height of the center points of the S-shaped segments of infeed guides 108.

Pivoting pivot beams 122 also increases or decreases the angle of beams 128, as shown in FIGS. 3A-3C. As will be understood, changing the angle of beams 128 also increases or decreases the horizontal and vertical offset of cross beams 130, which results in an increase or decrease in the curvature of the S-shaped segments of infeed guides 108. The increase or decrease in the curvature of the S-shaped segments of infeed guides 108 resulting from changes in the vertical and horizontal positions of cross beams 130 may counteract the curvature changes that would normally result from changing the height of the distal ends of infeed guides 108.

Figure 4:
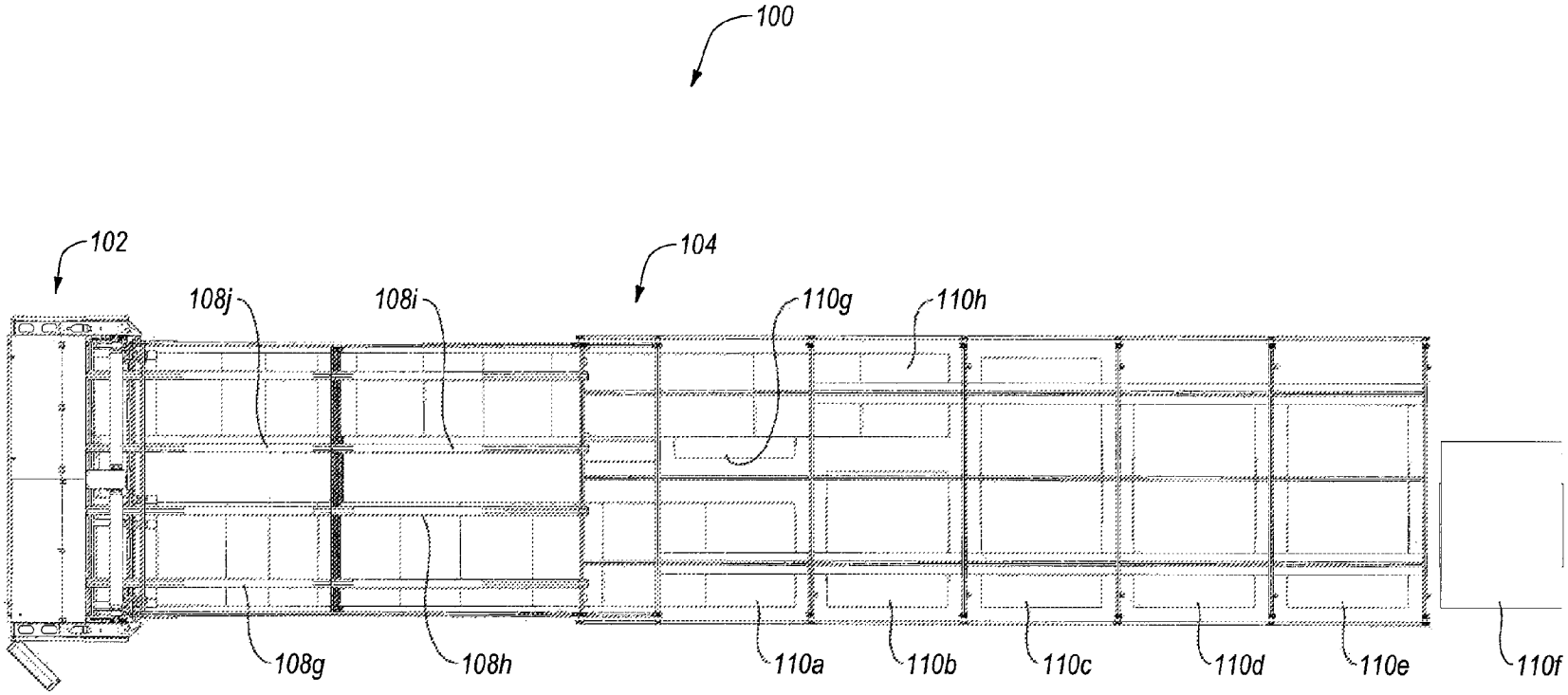
FIG. 4 illustrates a top view of the infeed guide system of FIG. 1.

In addition to being able to adjust the height of infeed guides 108 so that fanfold material 110 may be pulled from different stacks as discussed above, infeed guide system 104 may include infeed guides 108 that are vertically aligned and horizontally offset from one another. For instance, FIG. 4 illustrates a top view of converting system 100 with infeed guides 108*g*, 108*h*, 108*i*, and 108*j* horizontally offset from one another. Each of these infeed guides can be linked together so that their heights remain the same as one another as the cassette changer adjusts the infeed guides. Accordingly, infeed guides 108 may be arranged in a row-column configuration. For instance, vertically offset infeed guides 108*a*-108*g* may be considered to be arranged in a column, while horizontally offset infeed guides 108*g*-108*j* may be considered to be arranged in a row.

As shown in FIG. 4, converting system 100 may have a plurality of stacks of fanfold material 110 arranged in columns and rows. For instance, fanfold stacks 110*a*-110*f*, which are discussed above, are arranged in a row that extends away from converting machine 102. In order to pull fanfold material 110 from these different stacks, the cassette changer adjusts the height of the infeed guides 108*a*-108*g* to align the desired fanfold material 110 with the entry on converting machine 102. Thus, the row of fanfold stacks 110*a*-110*f* is associated with the column of infeed guides 108*a*-108*g*.

In addition to the row of fanfold stacks that include stacks 110*a*-110*f*, converting system may have additional rows of fanfold stacks. For instance, FIG. 4 illustrates fanfold stacks

110*g* and 110*h* arranged in a row extending away from converting machine 102. Stacks 110*a* and 110*g* form a first column, whiles stacks 110*b* and 110*h* form a second column. Stacks 110*c*, 110*d*, 110*e*, 110*f* each form their own column. Arranging stacks 110*a*-110*h* in a row and column configuration allows fanfold material 110 to be pulled from a larger number of stacks that are arranged in a smaller footprint. Additionally, fanfold material 110 may be simultaneously pulled from stacks within the same column. For instance, fanfold material 110 from stacks 110*a* and 110*g* may be fed through infeed guides that are vertically aligned so that converting machine can pull from these two stacks at the same time.

Although FIG. 4 illustrates infeed guide system 104 accommodating eight fanfold stacks arranged in a particular row-column configuration, it will be understood that the present invention may be modified, expanded, or contracted to accommodate nearly any number or arrangement of fanfold stacks. For instance, infeed guide system 104 may include more or fewer vertically offset and/or horizontally offset infeed guides 108 to accommodate more or fewer stacks of fanfold material.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A feed system for feeding raw material into a converting machine, the feed system comprising:

a plurality of infeed guides, each of the plurality of infeed guides comprising a first end, a second end disposed adjacent said converting machine, and a S-shaped segment between the first and second ends, the S-shaped segment having a center portion, wherein raw material can be fed between the first and second ends through the S-shaped segment, wherein the plurality of infeed guides comprises two or more vertically spaced apart infeed guides that define one or more guide passages through which the raw material can be passed; and a frame supporting the plurality of infeed guides, the frame comprising a pivoting frame that is adapted to selectively change the height of the center portion of each S-shaped segment of the plurality of infeed guides.

2. The feed system recited in claim 1, wherein the height of the second end of each infeed guide can be changed to direct a different raw material into said converting machine.

3. The feed system recited in claim 2, wherein the pivoting frame changes the height of the center portion of each S-shaped segment when the height of the second end of each infeed guide is changed.

4. The feed system recited in claim 1, wherein the pivoting frame comprises at least one pivoting beam having a first end that is pivotally coupled to a main frame structure.

5. The feed system recited in claim 4, wherein the at least one pivoting beam comprises a second end operatively associated with a cassette changer that is adapted to change the height of the second ends of the plurality of infeed guides, wherein the height of the second end of the at least one pivoting beam changes in correspondence with the changing heights of the second ends of the plurality of infeed guides.

6. The feed system recited in claim 5, wherein the at least one pivoting beam is linked to the center portions of the S-shaped segments of the infeed guides, whereby changes in the height of the second end of the at least one pivoting beam causes a change in the height of the center portions of the S-shaped segments of the infeed guides.

7. The feed system recited in claim 1, wherein the raw material comprises a fanfold material.

8. The feed system recited in claim 7, wherein the fanfold material is fanfold corrugated board.

9. A converting system used to convert fanfold material into packaging templates for assembly into boxes or other packaging, the fanfold material being stacked and having score lines separating layers of the fanfold material, wherein the converting system comprises:

a converting machine configured to receive and perform one or more conversion functions on said fanfold material, the one or more conversion functions including creasing, bending, folding, perforating, cutting, scoring, or any combination thereof, to create said packaging template; and an infeed guide system disposed adjacent to the converting machine, the infeed guide system comprising:

a plurality of infeed guides adapted to direct said fanfold material into the converting machine, each of the plurality of infeed guides having a first end, a second end disposed adjacent the converting machine, and a S-shaped segment between the first and second ends, wherein the second end of each infeed guide is adapted for vertical repositioning; and a grate connected to the plurality of infeed guides, wherein the grate is adapted to vertically reposition a center portion of the S-shaped segments of the plurality of infeed guides when the second ends of the infeed guides are vertically repositioned.

10. The converting system of claim 9, further comprising an elevation cassette changer disposed between the plurality of infeed guides and the converting machine.

11. The converting system of claim 10, wherein the elevation cassette changer comprises a cassette associated with each of the plurality of infeed guides, and wherein the elevation cassette changer is adapted to change the height of each cassette and the infeed guides associated therewith.

12. The converting system of claim 9, wherein the plurality of infeed guides comprises a plurality of rows and a plurality of columns of infeed guides.

13. The converting system of claim 9, wherein the curvature of each S-shaped segment is configured to direct said fanfold material between the first and second ends without creating additional folds, creases, or scores in said fanfold material.

14. The converting system of claim 9, wherein the grate is adapted to maintain the curvature of each S-shaped segment within a predetermined range during the vertical repositioning of the second ends.

15. The converting system of claim 9, wherein said plurality of infeed guides are configured to enable said fanfold material to be fed forwards and backwards without creating folds, creases, or scores in said fanfold material and without said fanfold material becoming jammed in the infeed guides.

16. The converting system of claim 9, wherein the height and vertical orientation of the grate changes as the second ends of the infeed guides are vertically repositioned, whereby a curvature of the S-shaped segments is maintained within a predetermined range as the second ends of the infeed guides are vertically repositioned.

17. A guide system comprising:

a plurality of infeed guides, each of the plurality of infeed guides comprising a first end, a second end, and a S-shaped segment between the first and second ends, the S-shaped segment having a center portion, wherein planar material can be fed between the first and second ends through the S-shaped segments, and wherein the second ends of the infeed guides are adapted for vertical repositioning; and a frame supporting the plurality of infeed guides, the frame comprising a grate connected to the center portions of the S-shaped segments, wherein the height and vertical orientation of the grate changes as the second ends of the infeed guides are vertically repositioned, whereby the curvature of the S-shaped segments is maintained within a predetermined range as the second ends of the infeed guides are vertically repositioned.

18. The guide system of claim 17, wherein the frame further comprises one or more pivoting beams from which the grate is suspended.

19. The guide system of claim 18, wherein each of the one or more pivoting beams has a first end and a second end, the second ends of the one or more pivoting beams being adapted for vertical repositioning, the vertical repositioning of the second ends of the one or more pivoting beams being linked to the vertical repositioning of the second ends of the infeed guides.

* * * * *